United States Patent [19]

Smith et al.

[11] Patent Number: 4,653,957

[45] Date of Patent: Mar. 31, 1987

[54] AIR DRIVEN VIBRATION CEMENT FLOAT

[76] Inventors: Wallis W. Smith, P.O. Drawer 366, Highlands, Tex. 77562; William E. Fairbanks, 8131 Wind Forest, Houston, Tex. 77040

[21] Appl. No.: 747,269

[22] Filed: Jun. 21, 1985

[51] Int. Cl.[4] ..... E01C 19/38

[52] U.S. Cl. ..... 404/114; 404/97; 15/235.4

[58] Field of Search ..... 404/97, 102, 113, 114, 404/118; 15/22 R, 235.4; 173/49; 181/230; 251/264, 318

[56] References Cited

U.S. PATENT DOCUMENTS

| | | | |
|---|---|---|---|
| 1,608,004 | 11/1926 | Schoenberger | 251/318 |
| 2,023,915 | 12/1935 | Connell | 251/318 |
| 2,400,341 | 5/1946 | Day et al. | 404/113 |
| 2,411,317 | 11/1946 | Day et al. | 15/235.4 |
| 2,514,626 | 7/1950 | Clipson | 404/113 |
| 3,137,365 | 6/1964 | Bingel | 181/230 |
| 3,283,352 | 11/1966 | Hu | 15/22 R |
| 3,376,798 | 4/1968 | Bodine | 15/235.4 X |
| 3,547,223 | 12/1970 | Gibel | 181/230 |
| 3,993,159 | 11/1976 | Amador | 181/230 |
| 4,431,336 | 2/1984 | Nightengale et al. | 404/97 |

*Primary Examiner*—Stephen J. Novosad
*Assistant Examiner*—John F. Letchford
*Attorney, Agent, or Firm*—Robert M. Carwell

[57] ABSTRACT

A pneumatically energized hand-held vibrating cement float. A rectangular base plate is provided for contacting the surface of wet cement. Centrally disposed intermediate the ends of the base plate is a rotary ball vibrator, extending from which is a handle terminating in a pneumatic coupling. Fluid communication is provided internally of the handle between the coupling and the vibrator. Upon introducing pressurized air to the coupling, the base plate, which is in contact with the cement, vibrates in an amount sufficient to work suspended gravel and the like downward and to provide a finished surface.

8 Claims, 4 Drawing Figures

FIG. 3
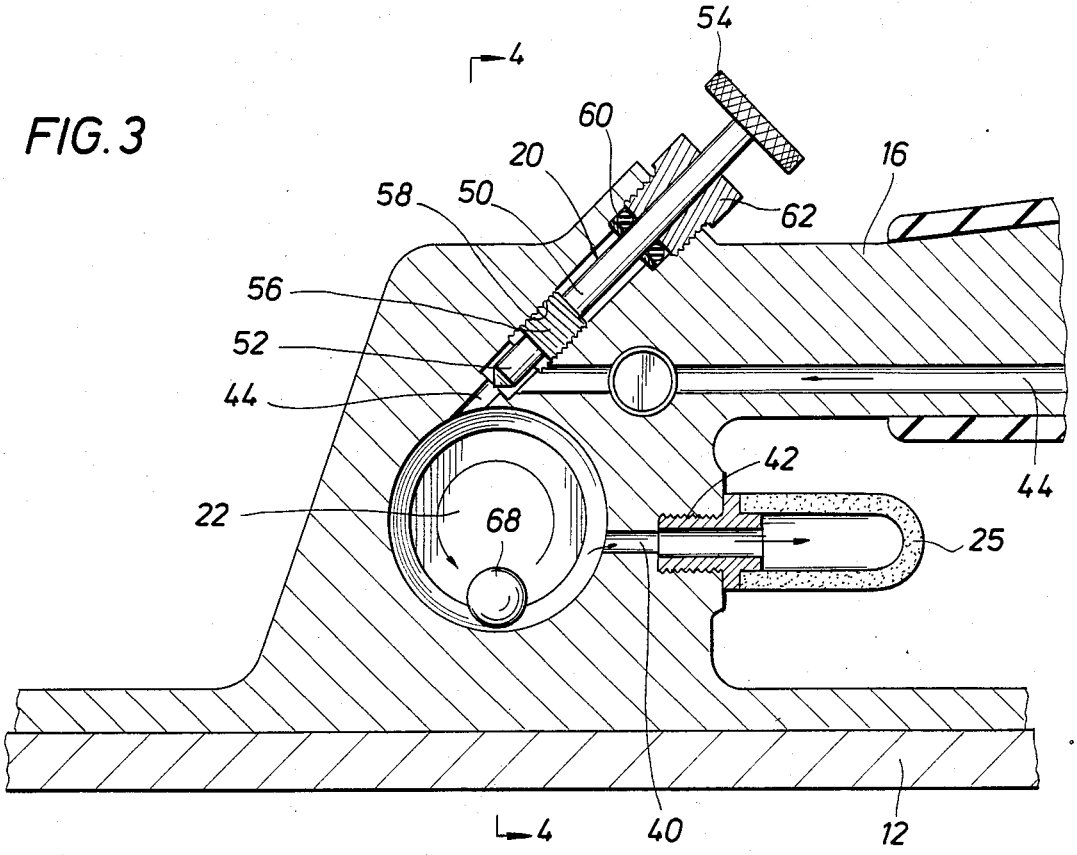
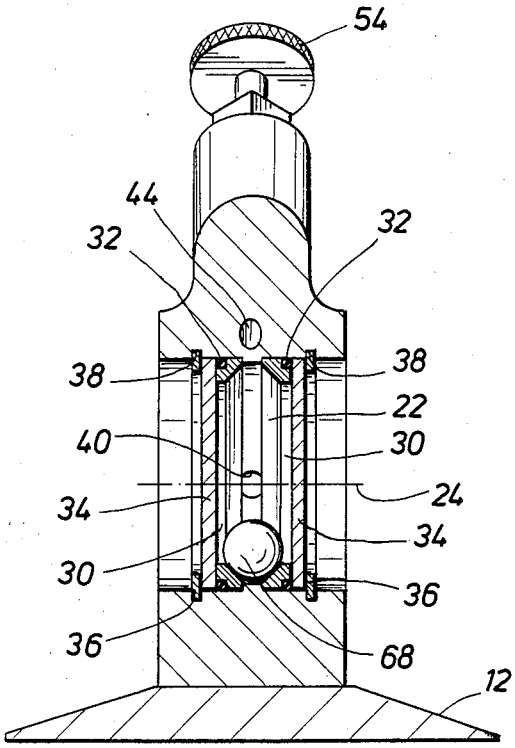
FIG. 4

AIR DRIVEN VIBRATION CEMENT FLOAT

BACKGROUND OF THE INVENTION

This invention relates to devices for working concrete surfaces, and more particularly to a vibratory device of the hand-held float type.

A wide variety of tools exists in the art for working cementitious materials into a finished form including various forms of bull floats, hand floats, and speciality tools including edgers, joiners, and trowls. In a typical job, a layer of wet concrete will be delivered to the work situs, whereupon the worker will commence spreading the concrete into a desired layer by means of shovels, screeding devices, also well known in the art, and the like. After the concrete is thus spread into the generally desired form, a process of generally compressing and further smoothing the concrete layer may thence begin by means of a large bull float or the like extending from an elongate handle. Next, more detailed work frequently commences, generally by means of a hand-held float in attempting to further compact the concrete for purposes including the driving of suspended gravel downwards, and developing a wetted surface slurry or soup-like finish, whilst further driving out air pockets and the like for preparing the surface for final finishing. Thereafter, when the surface slurry is thus formed, it is conventional to employ a smoothing or finishing trowl to develop a very smooth surface and to employ the aforementioned specialty tools such as edgers or the like for providing finishing touches to the work such as curved edges or the like.

It is generally known that concrete which is usually composed of an aggregate of cement, sand, gravel, rock of graded or miscellaneous sizes, and water, when mixed and layed or poured, generally contains voids which if not tamped or worked would not result in a desired homogeneous body. Moreover, the surface would take on a highly undesirable rough and uneven finish which, after partial setting of the concrete, would render the surface difficult if not impossible to finish to the desired smooth and even consistency. This is particularly the case with drier mixes wherein pieces of rock or gravel of the aggregate may have an even greater tendency to remain close to or above the desired final surface so as to interfere with any final finishing, leveling, or other contouring or smoothing operations as aforesaid.

For this reason, it has long been known in the art that in the act of providing a first general compacting, tamping, screeding or other such operation following the laying or dumping of the mix, various large vibrating devices may be benefically employed. Illustrative embodiments of such large vibrating tampers or the like may be seen in U.S. Pat. Nos. 3,306,174 to Wardell, 2,289,248 to Davis, 1,955,101 to Sloan, and 2,209,656 to Mall. These devises generally include a rather large flat base plate surface having disposed thereon a heavy and bulky vibrating means with an elongate handle having the appearance of a broom handle or the like attached thereto for moving the large plate across the concrete surface. Such devices are obviously intended for providing a first, general smoothing and compacting operating over a large area.

When the worker has progressed to the aforementioned finishing stage wherein it is desired to provide a highly smoothed surface finish, a variety of vibrating hand trowels have also been provided and employed with varying degrees of success. Representative examples of such trowels which are primarily for smoothing or finishing work, may be seen represented in U.S. Pat. Nos. 3,376,798 to Bodine, 2,514,626 to Clipson, and 2,411,317 to Day et. al. Whereas such trowels are, in contrast to the aforementioned larger devices, intended for hand-held operation, they retain several characteristics of the larger apparatus such as being of a rather awkward large and heavy construction, illustrative of which is the trowel disclosed in the Day patent. Whereas such features may in fact be beneficial with respect to the larger devices, in a hand-held tool this bulk, weight, and complexity may render the tool totally impractial for use, particularly in view of the fact that the operator is typically working for long periods of time on his knees and often in awkward positions. It must be recognized that these trowels are conventionally used primarily in the finishing operations wherein a great deal of vibratory energy is not required inasmuch as a mere final smoothing of the surface slurry is being effected. In these instances, a much less bulky vibrating means might be provided although, as aforesaid, most designs nevertheless continue to suffer from undue weight, bulk and the like, notwithstanding that a variety of such vibrating means have been attempted to be employed including plunger-type vibrators, (as disclosed in the patent to Clipson), air driven turbine vibrators, as disclosed in the patent to Day, and even sonic air-driven orbiting-mass type vibrators as illustrated in the patent to Bodine.

It will be recalled that in the stage of forming concrete between the use of the large spreading and compacting devices and the finishing work provided by trowels and specialty tools, an intermediate floating operation is nevertheless frequently necessary wherein a hand-held float is employed. In this operation it is conventional to hand-tap the concrete surface as aforesaid to drive the rock and gravel aggregate downwards and to bring a slurry to the surface for the final finishing operation. In such an intermediate operation, a relatively more substantial amount of force must be imparted to the mixture to achieve these objectives than is necessary to effect the final finishing with the finish trowels in the manner previously described. It will be appreciated that this intermediate step can become quite laborious and exhausting when large surfaces are involved. Moreover, and often more serious, is the fact that concrete will begin the setting process often very rapidly such that if this intermediate step is not performed within the required time, an unsatisfactory result is obtained.

Accordingly, it would be highly desirable to provide a hand-held cement float of an automatically vibrating variety for purposes of performing this intermediate hand-held floating step wherein a substantial vibratory energy is imparted to the concrete surface. However, as previously mentioned, existing hand-held vibratory trowel devices have been unsuited for this application for a number of reasons. Not only have such trowel designs been found impractical due to their large weight and bulk, but they have further been found unsatisfactory in delivering an approporate amount of vibratory energy to effect the development of the slurry and downward movement of the suspended rocks and gravel. It was accordingly thought such a hand-held vibrating float could not be provided which was at the same time compact, light in weight, and of an extremely simple and uncluttered design, yet at the same time employing a particular vibrating means capable of delivering sufficient vibratory energy to accomplish the objectives of the intermediate floating step. Nevertheless, these objectives and features have been obtained with the present invention which will appear as the description of a presently preferred form of the invention in a simple and illustrative form proceeds with reference to the accompanying drawings.

SUMMARY OF THE INVENTION

A pneumatically energized hand-held vibrating cement float is depicted. A rectangular base plate is provided for contacting the surface of wet cement. Centrally disposed between the ends of the base plate is a rotary ball vibrator assembly, extending from which is a elongate handle terminating in a pneumatic coupling. Fluid communication is provided internally of the handle between the coupling and the vibrator assembly. Upon introducing pressurized air to the coupling, the base plate which may be brought in contact with the cement, vibrates in an amount sufficient to work suspended gravel and the like downward and to provide a finished surface.

BRIEF DESCRIPTION OF THE DRAWINGS

FIG. 3 is an elevational view, in section, of a portion of the float depicted in FIG. 1.

FIG. 4 is an end view, partially in section, of a portion of the float depicted in FIG. 3, taken along line 4—4.

DETAILED DESCRIPTION OF THE INVENTION

Figure 2:
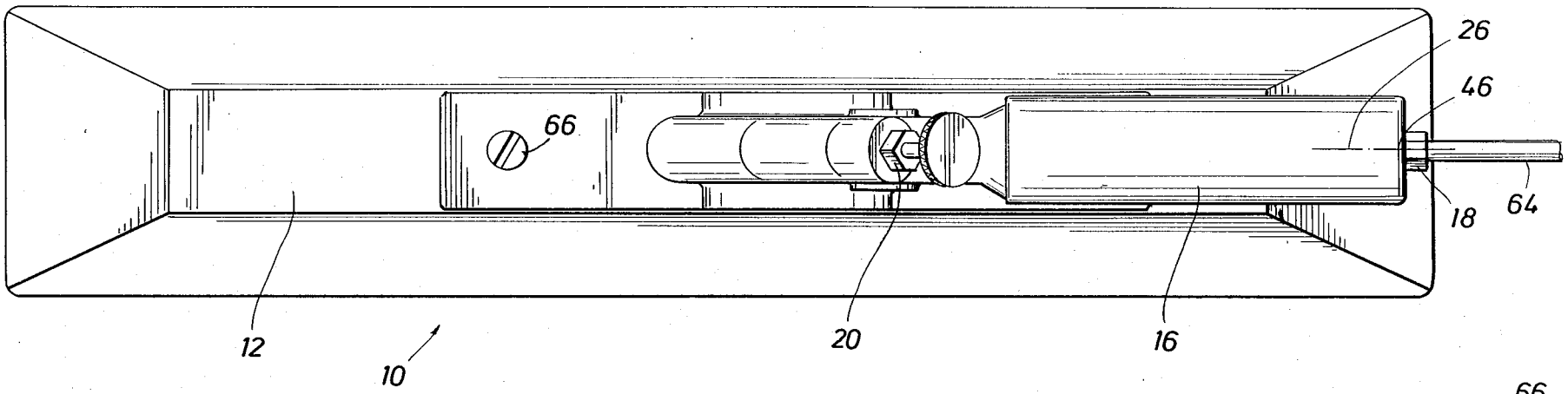
FIG. 2 is a pictorial top view of the float illustrated in FIG. 1.
Figure 1:
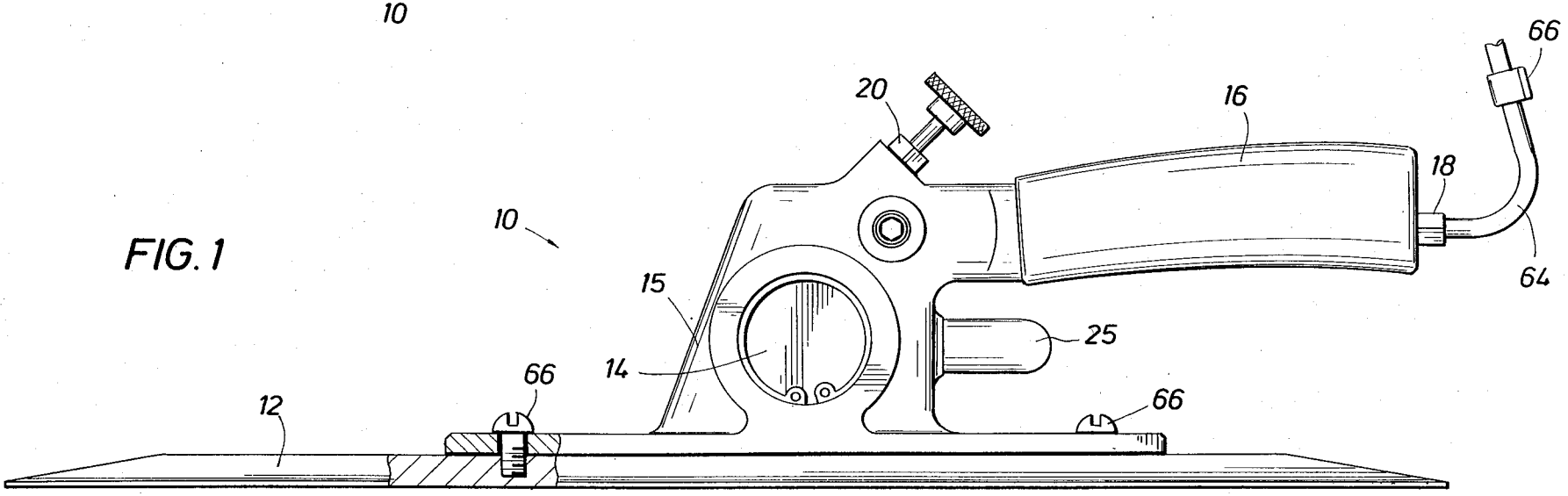
FIG. 1 is a pictorial elevational view of a pneumatically energized vibrating cement float of the present invention.

With reference to FIG. 1, there will be seen depicted therein generally a vibrating cement float 10 of the present invention comprised generally of a rectangular shaped base plate 12, an air driven rotary ball vibrator assembly 14 mounted in a vibrator body 15, a handle 16 connected to body 15, a pneumatic connector 18, a pressure regulator valve assembly 20, and a muffler 25.

First, with respect to the base plate 12, it will preferably be fashioned of a light weight material such as aluminum or the like, and will further preferably have an approximate length of 15½", width of 3¼", and a nominal thickness of ⅜. The vibrator body 15 may be conveniently attached to the plate 12 by any conventional means such as bolts 66 at opposed ends.

With respect to the ball vibrator assembly 14, it will be appreciated that such vibrator assembly will preferably take the form of a conventional industrial rotary ball vibrator, an illustrative example of which is comprised of the BS series model designation of vibrators available from the American Precision Vibrator Company. In general such vibrators include a vibrator body defining an internal chamber containing a dense metallic ball therein, with an input and output port to the chamber being provided. Upon providing a source of pressurized air to the input port, the ball is made to vibrate and oscillate within the chamber contacting the walls thereof to provide vibration to any desired body fixedly attached to the vibrator body. Pressurized air flow is, of course, from the input port into the vibrator body and thence outwards through the output port.

With respect to the aforementioned rotary ball vibrator assembly 14 as it is employed in the subject invention, it will be noted from FIG. 1 that the aforementioned vibrator body 15 may be provided in the float 10 depicted in FIG. 1 by means of providing a hollowed out chamber portion 22 within the body 15. (See FIGS. 3 and 4.) Coaxially aligned along axis 24 which is transverse to the longitudinal axis 26 of the base plate 12 is a plurality of components to be hereinafter described in greater detail. First disposed in and carried by the body 15 in mating engagement therewith adjacent the vibrator chamber 22 are a pair of racers 30. Axially outwards thereof along axis 24 and again on either side of the handle 16 are a pair of O-rings 32. Still further axially outwards of and in coaxial alignment along axis 24 are a pair of disc-shaped side plates. Finally, axially outwardmost on either side of the handle 16 in coaxial alignment along axis 24, a pair of retainer rings 36 are provided which are retainedly and removedly received by correlative mating grooves 38 in body 15 for purposes of holding the aforementioned racers, O-rings, and side plates in sealed assembly so as to close the chamber off pneumatically. A ball 68 is disposed within chamber 22, whereby when airflow is introduced into chamber 22 the ball 68 Will be vigorously impelled against the wall defining chamber 22 in an oscillating fashion so as to impart its momentum to body 15 and thus provide vibratory energy to plate 12.

In a preferred embodiment, due to the prolonged operation of the float 10 and the desire to provide some form of noise abatement, the output port 40 of the vibrator assembly may be provided with an appropriate silencer or muffler 25 which may be threadedly attached to the body 15 by threaded portion 42.

With reference to FIG. 3, it will be noted that in the embodiment depicted therein a hollow passageway 44 is provided internally of the handle 16 providing fluid communication from the vibrator assembly 14 to the valve assembly 20 to the input port 46 and to the pneumatic connector 18 disposed on the end of the handle 16. With respect to the valve assembly 20 itself, it is preferably of a needle valve type well known in the art. The valve assembly includes a valve body having a longitudinal axis therethrough, and an end 52 movably and rotatably extendable into chamber 44 to close off a desired portion of the fluid passage 44 extending through the handle 16 to regulate flow of air therethrough. The valve assembly 20 further includes at the end of valve body 50 a termination in a disk shaped adjustment knob 54. The body 50 also has a threaded portion 56 which is threadedly received by mating internal threads 58 of the valve body 15. Additionally, an O-ring 60 is provided contained by a retainer 62 threadedly held by the valve body 15 so as to seal off the outer srface of the cylindrical needle valve shaft body 50 and to provide a fluid seal between the air passageway or chamber 44 and the ambient. It will be noted that upon rotation of the cylindrical shaft body 50 by means of the knob 54, the tip portion 52 of the shaft body 50 may be moved into the chamber 44 extending through the valve body 15 to any desired degree. In this manner, when the end portion 52 of the shaft body 50 is selectively positioned at a desired distance into the chamber 44 the air flow therethrough may be adjusted to any desired degree so as to regulate the proper operation of the vibrator assembly 22.

In operation, an appropriate source of pneumatic fluid pressure such as an air pump or the like is provided whereby this source is conveyed to the pneumatic connector 18 by a convenient means such as the pneumatic hose 64 shown. It will be noted that the hose is provided with a clip 66 adjacent the float assembly 10, e.g. located for example 2–3 feet from the handle 16 whereby the hose 64 may conveniently be attached to the clothing of the operator by means of the clip 66 so as to keep the hose 64 out of the way of the operator during operation of the float assembly 10. In the preferred embodiment presently being described, the pressure source will preferably provide an air pressure within the range of 40 to 80 psi. Upon actuating the pressure supply so the pressurized air is provided to the connector 18, the knob assembly 20 is thence adjusted to provide the desired air flow through chamber 44 to the vibrator assembly 14. This will cause vibrator assembly 14 to vibrate in the desired amount which will, in turn, cause the base plate 12 to vibrate in the desired amount.

It is therefore apparent that the present invention is one well adapted to obtain all of the advantages and features hereinabove set forth, together with other advantages which will become obvious and apparent from a description of the apparatus itself. It will be understood that certain combinations and subcombinations are of utility and may be employed without reference to other features and subcombinations. Moveover, the foregoing disclosure and description of the invention is only illustrative and explanatory thereof, and the invention admits of various changes in the size, shape and details of the illustrated construction, without departing from the scope and spirit thereof.

What is claimed is:

1. A pneumatically-driven hand-held cement float comprising:

a base plate means for contacting said cement having first and second ends defining a longitudinal axis;

a single rotary ball vibrator means for imparting vibration to said base plate means in response to said pneumatic device, said vibrator means being positioned along said longitudinal axis;

a vibrator assembly body means carried by said base plate means for carrying said vibrator means; and a handle means interconnected to said body means for supporting said float defining an internal chamber therein in fluid communication with said vibrator means, said end of said handle means being spaced a vertical distance from said base plate means and terminating at a location above and substantially adjacent one of said ends of said base plate means.

2. The apparatus of claim 1, wherein said vibrator means is disposed intermediate the ends of said base plate, and includes a chamber having a raceway surface oriented in a vertical plane perpendicular to said base plate and a ball disposed in said chamber for traveling along said raceway surface.

3. The apparatus of claim 2, wherein said float further includes:

a valve means disposed between said handle means and said body means for adjusting fluid flow through said chamber.

4. The apparatus of claim 3, wherein said handle means and said base plate means are substantially parallel.

5. The apparatus of claim 4, wherein said float further includes:

an input port on the end of said handle; and a pneumatic connector in fluid communication with said input port for receiving a source of pneumatic pressure.

6. A pneumatically driven hand-held cement float comprising:

an elongate rectangular base plate with flat upper and lower surfaces having first and second ends and extending in the direction of a first longitudinal axis;

a vibrator assembly body carried by said upper surface and defining a single chamber therein disposed between said first and said second ends of said base plate along said axis and further defining an output port;

a ball disposed in said chamber;

an elongate handle extending in the direction of a second longitudinal axis substantially parallel to said first longitudinal axis above said upper surface of said base plate, said handle being interconnected at a first end to said vibrator assembly body at a location intermediate said first and said second ends of said base plate and terminating at a second end adjacent and above said second end of said rectangular plate, and said handle defining a passageway extending substantially in the direction of said second longitudinal axis and establishing fluid communication between said chamber and said second end of said handle.

7. The apparatus of claim 6, further including:

a source of pressurized air; and a tube interconnecting said air source and said second end of said handle.

8. The apparatus of claim 7, wherein said air source has a pressure in an amount sufficient to vibrate said ball within said chamber when air is delivered from said source through said tube and said passageway to said chamber.

* * * * *